US007520715B2

(12) United States Patent
Durocher et al.

(10) Patent No.: US 7,520,715 B2
(45) Date of Patent: Apr. 21, 2009

(54) TURBINE SHROUD SEGMENT TRANSPIRATION COOLING WITH INDIVIDUAL CAST INLET AND OUTLET CAVITIES

(75) Inventors: Eric Durocher, Verchères (CA); Assaf Farah, Charlemagne (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 466 days.

(21) Appl. No.: 11/183,741

(22) Filed: Jul. 19, 2005

(65) Prior Publication Data

US 2007/0020086 A1 Jan. 25, 2007

(51) Int. Cl.
*F01D 11/08* (2006.01)

(52) U.S. Cl. ..... 415/116; 415/176; 415/178

(58) Field of Classification Search ..... 415/115–117, 415/173.1, 173.2, 173.3, 175–178
See application file for complete search history.

(56) References Cited

U.S. PATENT DOCUMENTS

| | | | | |
|---|---|---|---|---|
| 4,013,376 | A | 3/1977 | Bisson et al. | |
| 4,497,610 | A | 2/1985 | Richardson et al. | |
| 5,374,161 | A | 12/1994 | Kelch et al. | |
| 5,482,435 | A | 1/1996 | Dorris et al. | |
| 5,486,090 | A | 1/1996 | Thompson et al. | |
| 5,584,651 | A | 12/1996 | Pietraszkiewicz et al. | |
| 6,126,389 | A | 10/2000 | Burdgick | |
| 6,146,091 | A | 11/2000 | Watanabe et al. | |
| 6,155,778 | A * | 12/2000 | Lee et al. | 415/116 |
| 6,179,557 | B1 | 1/2001 | Dodd et al. | |
| 6,224,329 | B1 | 5/2001 | North | |
| 6,508,623 | B1 | 1/2003 | Shiozaki et al. | |
| 6,554,566 | B1 | 4/2003 | Nigmatulin | |
| 6,742,783 | B1 | 6/2004 | Lawer et al. | |
| 6,811,378 | B2 | 11/2004 | Kraft | |

FOREIGN PATENT DOCUMENTS

| | | |
|---|---|---|
| JP | 2001-207863 | 8/2001 |

OTHER PUBLICATIONS

International Search Report dated Nov. 14, 2006 for corresponding PCT International Application No. PCT/CA2006/001184.

* cited by examiner

*Primary Examiner*—Christopher Verdier
(74) *Attorney, Agent, or Firm*—Ogilvy Renault LLP

(57) ABSTRACT

A shroud segment of a turbine shroud of a gas turbine engine comprises a platform with front and rear legs. The platform defines a plurality of axially extending holes with individual inlets on an outer surface of the platform for transpiration cooling of the platform of the turbine shroud segment.

12 Claims, 4 Drawing Sheets

TURBINE SHROUD SEGMENT TRANSPIRATION COOLING WITH INDIVIDUAL CAST INLET AND OUTLET CAVITIES

TECHNICAL FIELD

The invention relates generally to gas turbine engines and more particularly to turbine shroud segments configured for transpiration cooling of a turbine shroud assembly.

BACKGROUND OF THE ART

A gas turbine engine usually includes a hot section, i.e., a turbine section which includes at least one rotor stage, for example, having a plurality of shroud segments disposed circumferentially one adjacent to another to form a shroud ring surrounding a turbine rotor, and at least one stator vane stage disposed immediately downstream and/or upstream of the rotor stage, formed with outer and inner shrouds and a plurality of radial stator vanes extending therebetween. Being exposed to very hot gases, the rotor stage and the stator vane stage need to be cooled. Hereintofore, efforts have been made in various approaches for development of adequate cooling arrangements. Therefore, gas turbine engine designers have been continuously seeking improved configurations of turbine shroud segments which are not only adapted for adequate cooling arrangement of a turbine shroud assembly but also provide improved mechanical properties thereof, as well as convenience of manufacture.

Accordingly, there is a need to provide improved turbine shroud segments adapted for adequate cooling arrangement of a turbine shroud assembly.

SUMMARY OF THE INVENTION

It is therefore an object of this invention to provide turbine shroud segments adapted for adequate cooling arrangement of the turbine shroud assembly.

One aspect of the present invention therefore provides a turbine shroud segment of a turbine shroud of a gas turbine engine, which comprises a platform having a hot gas path side and a back side. The platform is axially defined between leading and trailing ends thereof and is circumferentially defined between opposite lateral sides thereof. The platform further defines a plurality of axially extending transpiration holes with individual inlets on the back side of the platform for transpiration cooling of the platform of the turbine shroud segment.

Another aspect of the present invention provides a turbine shroud of a gas turbine engine which comprises a plurality of circumferentially adjoining shroud segments and an annular support structure supporting the shroud segments together within an engine casing. Each of the shroud segments includes a platform and also includes front and rear legs to support the platform radially and inwardly spaced apart from the support structure in order to define an annular cavity between the front and rear legs. The platform defines a plurality of transpiration cooling passages extending therein and substantially axially therethrough. The transpiration cooling passages have individual inlets defined in the outer surface of the platform in fluid communication with the annular cavity for intake of cooling air therefrom.

These and other aspects of the present invention will be better understood with reference to preferred embodiments described hereinafter.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
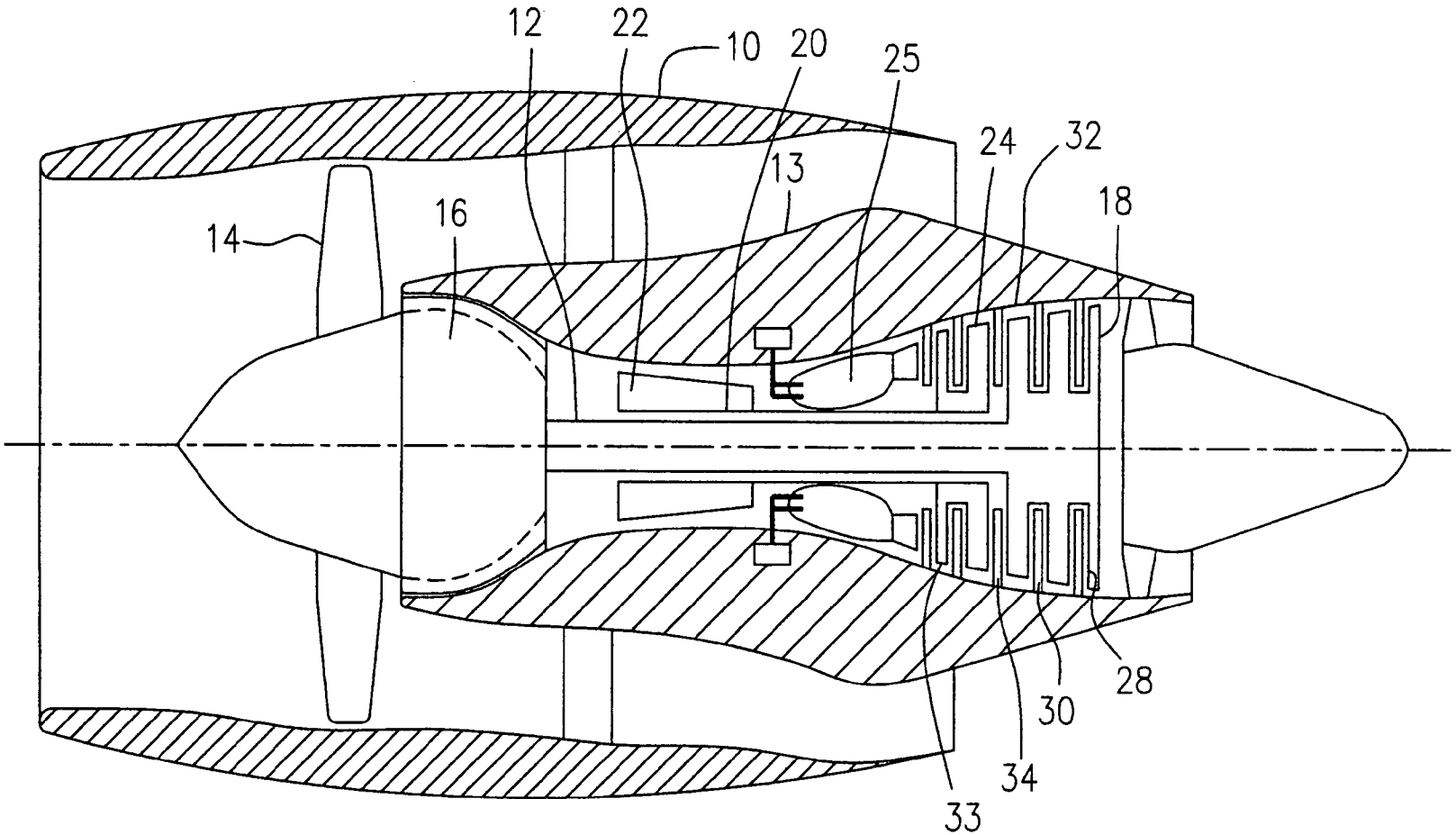
FIG. 1 is a schematic cross-sectional view of a gas turbine engine.

Referring to FIG. 1, a turbofan gas turbine engine incorporates an embodiment of the present invention, presented as an example of the application of the present invention, and includes a housing or a nacelle 10, a core casing 13, a low pressure spool assembly seen generally at 12 which includes a fan 14, low pressure compressor 16 and low pressure turbine 18, and a high pressure spool assembly seen generally at 20 which includes a high pressure compressor 22 and a high pressure turbine 24. There is provided a burner 25 for generating combustion gases. The low pressure turbine 18 and high pressure turbine 24 include a plurality of rotor stages 28 and stator vane stages 30.

Figure 2:
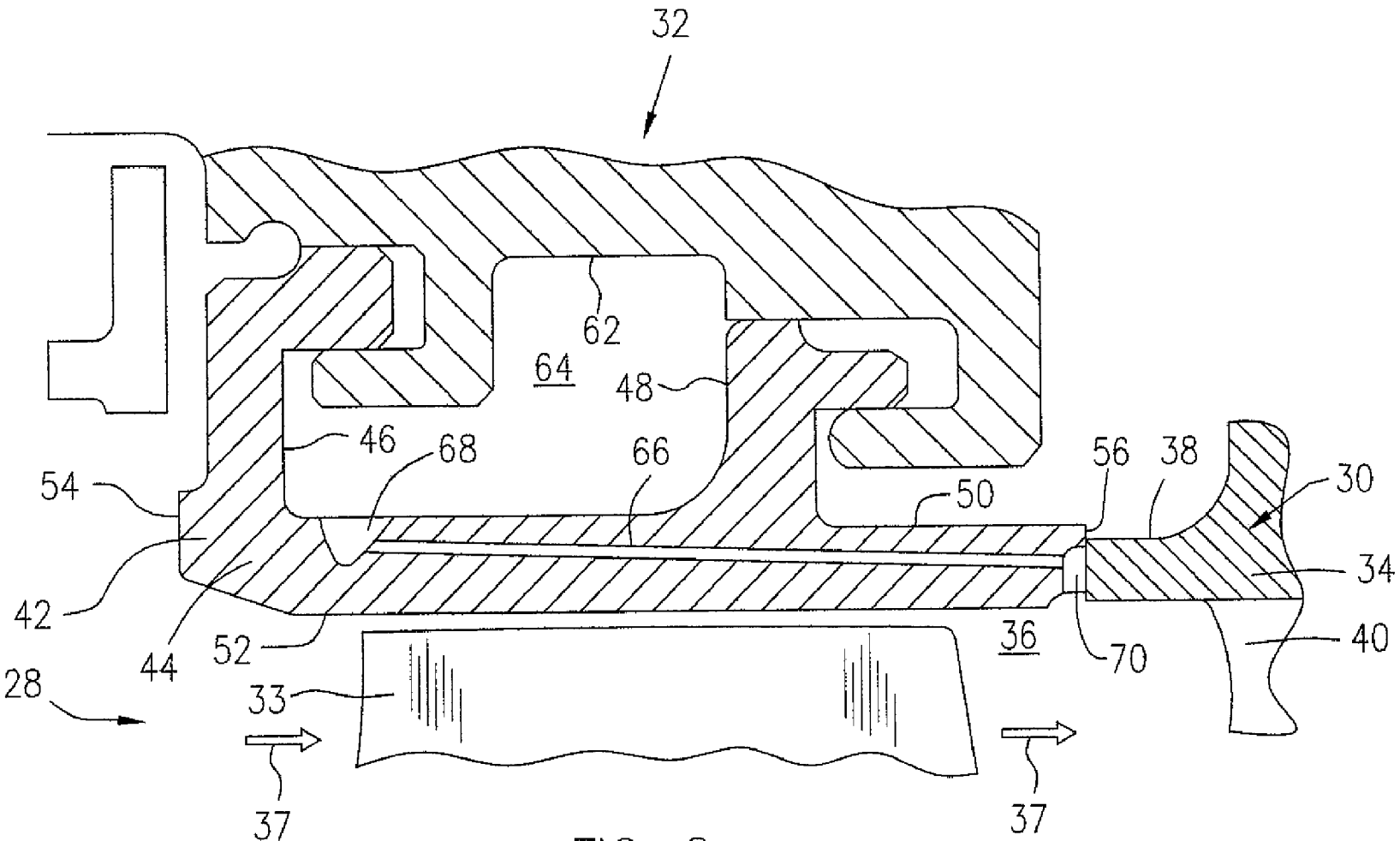
FIG. 2 is an axial cross-sectional view of a turbine shroud assembly used in the gas turbine engine of FIG. 1, in accordance with one embodiment of the present invention.
Figure 3:
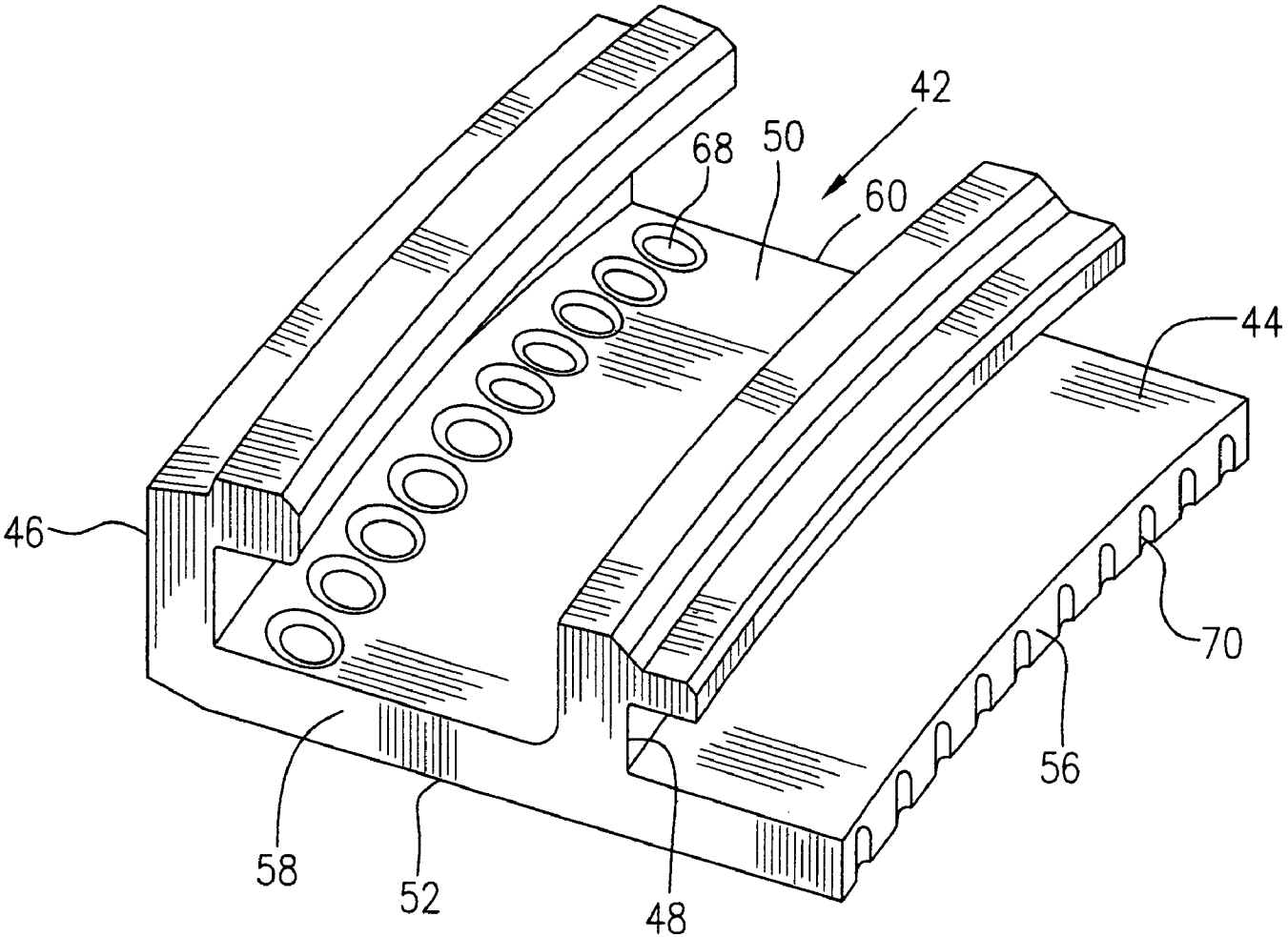
FIG. 3 is a perspective view of a shroud segment used in the turbine shroud assembly of FIG. 2.

Referring to FIGS. 1-3, each of the rotor stages 28 has a plurality of rotor blades 33 encircled by a turbine shroud assembly 32 and each of the stator vane stages 30 includes a stator vane assembly 34 which is positioned upstream and/or downstream of one of rotor stage 28, for directing combustion gases 37 into or out of an annular gas path 36 within a corresponding turbine shroud assembly 32, and through the corresponding rotor stage 28.

The stator vane assembly 34, for example a first stage of a low pressure turbine (LPT) vane assembly, is disposed, for example, downstream of the shroud assembly 32 of one rotor stage 28, and includes, for example a plurality of stator vane segments (not indicated) joined one to another in a circumferential direction to form a turbine vane outer shroud 38 which comprises a plurality of axial stator vanes 40 (only a portion of one is shown) which divide a downstream section of the annular gas path 36 relative to the rotor stage 28, into sectoral gas passages for directing combustion gas flow out of the rotor stage 28.

The shroud assembly 32 in the rotor stage 28 includes a plurality of shroud segments 42 (only one shown) each of which includes a platform 44 having front and rear radial legs 46, 48 with respective hooks (not numbered). The shroud segments 42 are joined one to another in a circumferential direction and thereby form the shroud assembly 32.

The platform 44 of each shroud segment 42 has a back side 50 and a hot gas path side 52 and is defined axially between leading and trailing ends 54, 56, and circumferentially between opposite lateral sides 58, 60 thereof. The platforms 44 of the segments collectively form a turbine shroud ring (not indicated) which encircles the rotor blades 33 and in combination with the rotor stage 28, defines a section of the annular gas path 36. The turbine shroud ring is disposed immediately upstream of and abuts the turbine vane outer shroud 38, to thereby form a portion of an outer wall (not indicated) of the annular gas path 36.

The front and rear radial legs 46, 48 are axially spaced apart and integrally extend from the back side 50 radially and outwardly such that the hooks of the front and rear radial legs 46, 48 are conventionally connected with an annular shroud support structure 62 which is formed with a plurality of shroud support segments (not indicated) and is in turn supported within the core casing 13. An annular cavity 64 is thus defined axially between the front and rear legs 46, 48 and radially between the platforms 44 of the shroud segments 42 and the annular shroud support structure 62. The annular middle cavity is in fluid communication with a cooling air source, for example bleed air from the low or high pressure compressors 16, 22 and thus the cooling air under pressure is introduced into and accommodated within the annular cavity 64.

The platform 44 of each shroud segment 42 preferably includes a passage, for example a plurality of transpiration holes 66 extending axially within the platform 44 for directing cooling air therethrough for transpiration cooling of the platform 44. In prior art, for convenience of the hole drilling, a groove (not shown) extending in a circumferential direction with opposite ends closed is conventionally provided, for example, on the back side 50 of the platform 44 such that transpiration holes 66 can be drilled from the trailing end 56 of the platform straightly and axially towards and terminate at the groove. Thus, such a groove forms a common inlet of the transpiration holes 66 for intake of cooling air accommodated within the cavity 64. However, this type of groove usually extends across almost the entire width of the platform 44 and has a depth of about a half the thickness of the platform 44. Therefore, the groove unavoidably and significantly reduces the strength of the platform 44 and thus the durability of shroud segment 42.

In accordance with one embodiment of the present invention, a plurality of individual inlets, preferably cast inlet cavities 68, instead of a conventional groove, are provided on the back side 50 of the platform 44, in order to overcome the shortcomings of the prior art, while providing convenience of manufacture for the hole-making in the platform 44. The transpiration holes 66 can be drilled from the trailing end 56 of the platform 44 axially towards and terminate at the individual cast inlet cavities 68. The number of cast inlet cavities 68 is equal to the number of the transpiration holes 66. The dimension of the individual cast inlet cavities 68 is preferably greater than the diameter of the respective transpiration holes 66. For example, the individual cast inlet cavities 68 may be shaped with a bell mouth profile which provides convenience for the casting process of the platforms 44. In contrast to the conventional groove as a common inlet of the transpiration holes 66, the body portions of the platform 44 remaining between the adjacent cast inlet cavities 66, effectively improve the strength of the platform 44 and thus the durability of the shroud segment 42.

The individual cast inlet cavities 68 are in fluid communication with the middle cavity 64 and thus cooling air introduced into the cavity 64 is directed into and through the axial transpiration holes 66 for effectively cooling the platform 44 of the shroud segments 42. The cooling air is then discharged at the trailing end 56 of the platform 42, impinging on a downstream engine part such as the turbine vane outer shroud 38, before entering the gas path 36.

The individual cast inlet cavities 68 are preferably located close to the front leg 46 such that the transpiration holes 66 extend through a major section of the entire axial length of the platform 44 of the shroud segment 42, thereby efficiently cooling the platform 44 of the shroud segment 42.

The transpiration holes 66 are preferably substantially evenly spaced apart in a circumferential direction and are preferably aligned with the turbine vane outer shroud. Thus, the cooling air impinges on the leading end of the turbine vane outer shroud 38. The number of transpiration holes 66 in each shroud segment 42 is determined such that the cooling air discharged from the transpiration holes 66 effectively cools the entire circumference of the leading end of the turbine vane outer shroud 38.

The trailing end 56 of the platform 44 is conventionally disposed in a very close or abutting relationship with the leading end (not indicated) of the turbine vane outer shroud 38, in order to prevent leakage of hot combustion gases flowing through the gas path 36. It is therefore preferable to provide one or more outlets in the trailing end 56 of the platform 44 for adequately discharging cooling air from the transpiration holes 66, thereby not only permitting the cooling air to flow through the transpiration holes 66 without substantial blocking but also directing the discharged cooling air to adequately cool the stator vane assembly 34.

In this embodiment a plurality of individual outlets, preferably individual cast outlet cavities 70, are provided in the trailing end 56 of the platform 44 of each shroud segment 42. For example, each cast outlet cavity 70 is configured as a groove (not indicated) extending radially in the trailing end 56 of the platform 44, with opposite ends: one end being closed and the other end opening onto hot gas path side 52 of the platform 44. The transpiration holes 66 are in fluid communication with and terminate at the individual grooves (the individual cast outlet cavities 70). Due to the restriction by the closed end of the radial grooves, the cooling air discharged from the transpiration holes 66 is directed to impinge the leading end of the turbine vane outer shroud 38, and upon impingement thereon is directed radially, inwardly and rearwardly, thereby further film cooling a front portion of the inner surface of the turbine vane outer shroud 38 and a portion of the axial stator vanes 40, prior to being discharged into hot combustion gases flowing through the gas path 36. In contrast to the cross-section of the transpiration holes 66, the individual cast outlet cavities 70 have an enlarged dimension which advantageously reduces the contact surface of the trailing end 56 of the platform 44 with the leading end of the turbine vane outer shroud 38, thereby minimizing fretting therebetween.

Figure 4:
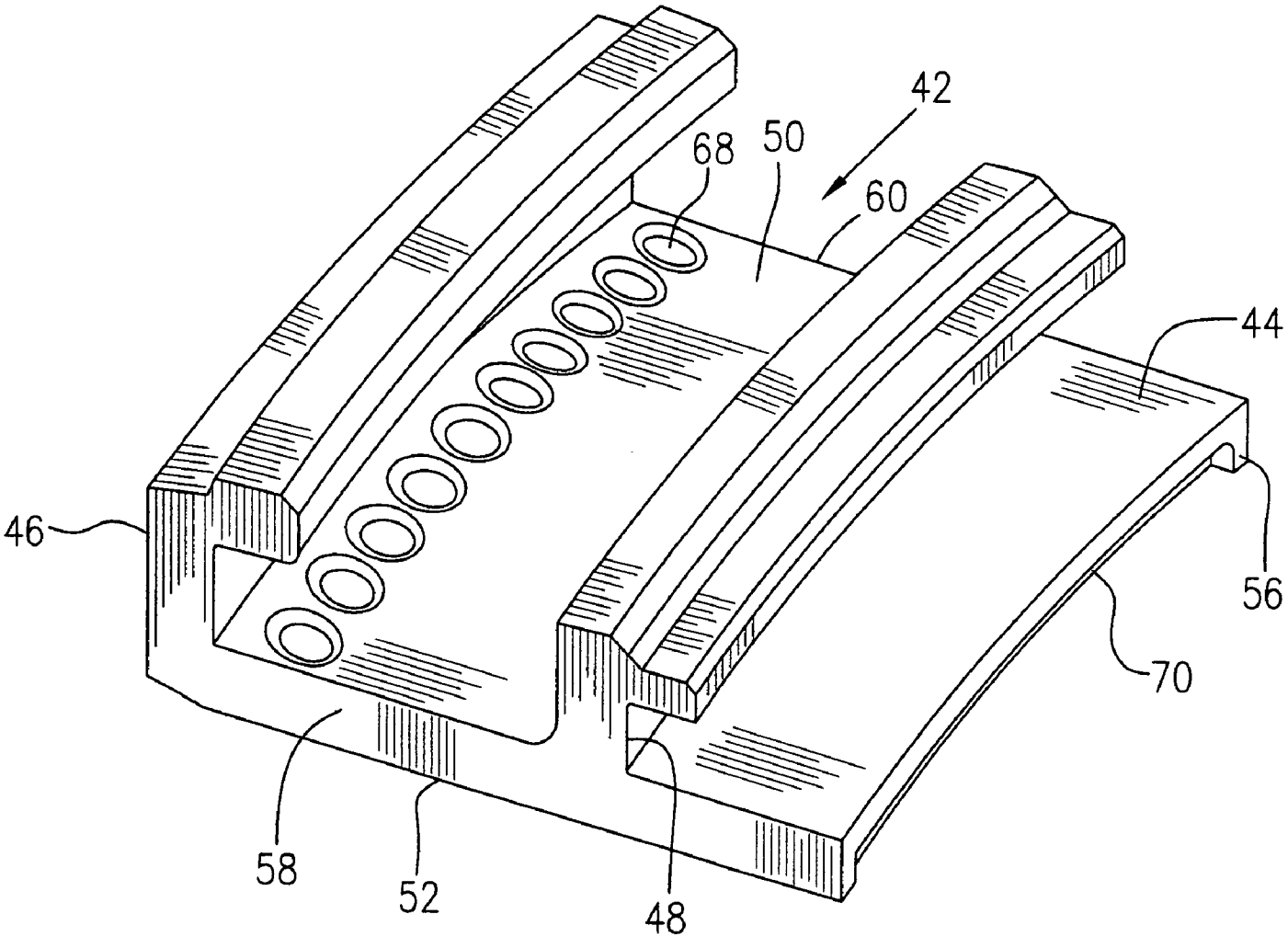
FIG. 4 is a perspective view of a shroud segment alternative to the shroud segment of FIG. 3, according to another embodiment of the present invention.

FIG. 4 illustrates another embodiment of the shroud segment 42 which is similar and alternative to the embodiment of FIG. 3 and will not be redundantly described. The only difference therebetween lies in that the individual cast outlet cavities 70 of FIG. 3 are replaced by an elongate, preferably cast, recess 70 which is a common outlet of the holes 66 and is provided in the trailing end 56 of the platform 44 with an opening defined on the hot gas path side 52 of the platform 44. The elongate recess 70 will provide a function generally similar to that of the individual outlets. However, individual outlets are preferable to a common outlet because cooling air streams discharged from the transpiration holes 66 through the individual outlets 70 will not interfere with one another when approaching the leading end of the turbine vane outer shroud 38 for impingement cooling thereof.

The above description is meant to be exemplary only, and one skilled in the art will recognize that changes may be made to the embodiments described without departure from the scope of the invention disclosed. For example, the present invention can be applicable in any type of gas turbine engine other than the described turbofan gas turbine engine. The described individual inlet and outlet cavities may be used either in combination or in a separate manner in various configurations of turbine shroud segments. Other modifications which fall within the scope of the present invention will be apparent to those skilled in the art, in light of a review of this disclosure, and such modifications are intended to fall within the appended claims.

The invention claimed is:

1. A shroud segment of a turbine shroud of a gas turbine engine, comprising a platform having a hot gas path side and a back side, the platform being axially defined from a leading edge to a trailing edge in a direction from an upstream position to a downstream position of a hot gas flow passing through the turbine shroud, and being circumferentially defined between opposite lateral sides of the platform, the platform further defining a plurality of transpiration passages extending axially through the platform and a plurality of cavities on the back side, each cavity communication with only one of the passages to form an inlet with an enlarged diameter of said one passage, the passages configured for directing cooling air to pass through the platform toward the trailing edge, thereby achieving transpiration cooling of the platform of the turbine shroud segment.

2. The shroud segment as claimed in claim 1 wherein a first end of the passages terminates at the individual cavities.

3. The shroud segment as claimed in claim 1 wherein the inlets are located at an axial position between front and rear legs of the shroud segment.

4. The shroud segment as claimed in claim 3 wherein the axial positions of the inlets are located close to the front leg of the shroud segment, with respect to the rear leg.

5. The shroud segment as claimed in claim 1 wherein a second end of the passages terminates at a plurality of respective cast cavities defined in the platform, thereby forming individual outlets of the passage.

6. The shroud segment as claimed in claim 5 wherein each of the outlets is formed with a radially extending groove in the trailing end of the platform.

7. A shroud segment of a turbine shroud of a gas turbine engine, comprising a platform having a hot gas path side and a back side, the platform being axially defined from a leading edge to a trailing edge in a direction from an upstream position to a downstream position of a hot gas flow passing through the turbine shroud, and being cirumferentially defined between opposite lateral sides of the platform, the platform further defining a plurality of transpiration passages extending axially through the platform and a plurality of cavities on the back side, each cavity communicating with only one of the passages to form an inlet with an enlarged diameter of said one passage, the passages configured for directing cooling air to pass through the platform toward the trailing edge, thereby achieving transpiration cooling of the platform of the turbine shroud segment, wherein a second end of the passages terminates at a plurality of respective cast cavities defined in the platform, thereby forming individual outlets of the passages, wherein each of the outlets is formed with a radially extending groove in the trailing end of the platform, and wherein the grooves comprise respective opposite ends, one end being closed and the other end opening onto the inner surface of the platform.

8. A turbine shroud assembly of a gas turbine engine surrounding a turbine rotatable about an axis of rotation, comprising a plurality of circumferentially adjoining shroud segments and an annular support structure supporting the shroud segments together within an engine casing, each of the shroud segments including a platform extending axially from a leading edge to a trailing edge in a direction from an upstream position to a downstream position of a hot gas flow passing through the turbine shroud assembly, and also including front and rear legs to support the platform radially and inwardly spaced apart from the support structure in order to define an annular cavity between the front and rear legs, the platform defining a plurality of transpiration cooling passages axially extending through the platform and further defining a plurality of inlets in an outer surface of the platform, each inlet communicating with one of the passages and being in fluid communication with the annular cavity for intake of cooling air from the annular cavity, each of the cooling passages including one of enlarged outlets defined in the trailing edge of the platform.

9. The turbine shroud assembly as claimed in claim 8 wherein the axial cooling passages of each shroud segment comprise respective opposite ends, one end terminating at the respective inlets and the other end terminating at the respective outlets.

10. The turbine shroud assembly as claimed in claim 9 wherein the individual inlets are located close to the front leg such that the cooling passages extend through a majority of the entire axial length of the platform.

11. The turbine shroud assembly as claimed in claim 8 wherein the enlarged outlets have an opening defined in an inner surface of the platform.

12. The shroud segment as claimed in claim 6 wherein the grooves comprise respective opposite ends, one end being closed and the other end opening onto the inner surface of the platform.

* * * * *